US005370179A

United States Patent [19]

Mills

[11] Patent Number: 5,370,179

[45] Date of Patent: Dec. 6, 1994

[54] DRIVE HEAD FOR ROTARY DOWN HOLE PUMP

[76] Inventor: Robert A. R. Mills, 8903 Baylor Cr. SW, Calgary, AB, T2V 3N5, Canada

[21] Appl. No.: 92,222

[22] Filed: Jul. 15, 1993

[51] Int. Cl.[5] ..... E21D 43/00

[52] U.S. Cl. ..... 166/68.5; 175/195

[58] Field of Search ..... 166/68.5; 418/48; 175/195

[56] References Cited

U.S. PATENT DOCUMENTS

| | | | |
|---|---|---|---|
| 3,128,614 | 4/1964 | Auer | 64/23.5 |
| 3,848,684 | 11/1974 | West | 175/195 |
| 4,372,379 | 2/1983 | Kulhanek et al. | 166/68.5 |
| 4,655,058 | 4/1987 | Collet | 70/178 |
| 4,716,961 | 1/1988 | Makins, Jr. et al. | 166/68.5 |
| 4,797,075 | 1/1989 | Edwards et al. | 418/48 |
| 5,143,153 | 9/1992 | Bach et al. | 166/68.5 |

FOREIGN PATENT DOCUMENTS

| | | |
|---|---|---|
| 1180594 | 1/1985 | Canada . |
| 1251690 | 3/1989 | Canada . |
| 1279256 | 1/1991 | Canada . |
| 20916311 | 1/1991 | Canada . |
| 1285152 | 6/1991 | Canada . |

OTHER PUBLICATIONS

"Peerless Pumps . . . " A comprehensive catalog of vertical and horizontal pumps manufactured by Peerless Pump Division, 1952.

*Primary Examiner*—William P. Neuder

*Attorney, Agent, or Firm*—Andrus, Sceales, Starke & Sawall

[57] ABSTRACT

A drive head for a down hole rotary pump driven from a well head assembly by a drive string that extends through the well to the pump is disclosed. The drive head includes a hollow rotatable drive shaft having an axial passage for accommodating a slip shaft, a housing attachable to the well head assembly, radial bearings centering the drive shaft in the housing and a thrust bearing for supporting the weight of the drive shaft and the drive string suspended therefrom. A pulley is mounted on the shaft for driving the drive shaft. The slip shaft is mounted to the top end of a polished rod which is attached to a top end of the drive string. The slip shaft and the passage in the drive shaft are preferably hexagonal so that drive torque is transmitted to the drive string without slippage of the shaft. The drive string is suspended in the well by a clamp that grips a top end of the slip shaft and rests on a top of the housing. The advantages include the elimination of damage to the polished rod and/or the down hole pump due to polished rod clamp slippage, improved transmission of drive power, and a drive train that cannot be lost down the well when a clamp slips or breaks.

12 Claims, 4 Drawing Sheets

DRIVE HEAD FOR ROTARY DOWN HOLE PUMP

FIELD OF THE INVENTION

The invention relates to rotary down hole pump systems and more particularly to drive heads for rotary down hole pumps.

BACKGROUND OF THE INVENTION

Rotary down hole pumps such as progressing cavity pumps have been used in water wells for many years. More recently, they have been found especially well-suited for the pumping of very viscous or thick fluids such as crude oil laden with sand. Rotary down hole pumps are generally driven by a drive string consisting of a rotating rod or tube string that extends down a well bore through a well casing or a production tubing. The drive string has a polished rod at its upper end which extends through the well head to facilitate sealing the well head around the periphery of the drive string. The drive string is suspended from and rotated by a drive head assembly associated with the well head. The pump rotor is mounted to the bottom end of the drive string and the pump stator is connected to the production tubing.

The drive head assembly must support the weight of the drive string, which is quite substantial for deep wells. The drive head assembly must also permit vertical displacement of the drive string to permit proper positioning of the pump rotor in the pump stator. In relatively shallow water wells, only very limited vertical displacement of the drive string is required and this can be accommodated by a threaded rod and nut connection between the drive string and the drive head. An example of this type of connection is disclosed in a catalog of the Peerless Pump Division of F.M.C. Corporation, Bulletin No. B-127 (1952). Deep oil well drive strings may require a substantially greater capacity for vertical displacement to maintain a proper position of the pump rotor due to stretching of the drive string, etc. A drive head assembly described by Kulhanek et al in U.S. Pat. No. 4,372,379 discloses a drive head arrangement having the required capacity for vertical displacement. However, for reliable and safe operation of a rotary down hole pump, the drive head must not only permit vertical displacement but must also permit the reliable transmission of sufficient torque to the drive string to accommodate the pumping of very viscous fluids from deep wells.

The drive head assembly disclosed by Kulhanek et al includes a hollow spindle through which the drive string extends, a frame which rotatably supports the spindle on the well head, and a chain and sprocket drive for rotation of the spindle. The drive string is suspended from the spindle by a standard polished rod clamp which rests in a complementary recess in the top of the spindle. This arrangement permits a transmission of torque from the spindle to the drive string. However, standard polished rod clamps are designed to suspend but not to rotate a drive string, and slippage of the clamp under high torque may result in a loss of the drive string down the well which can cause serious damage to the well casing and the down hole pump.

In U.S. Pat. No. 4,716,961 Makins et al disclose a rotating and supporting drive assembly wherein the weight of the drive string is suspended from the top of a drive spindle by a standard polished rod clamp. The drive string is rotated by a dog clutch arrangement similar to the arrangement described in Kulhanek et al, but the polished rod clamp is positioned at the bottom end of the spindle. Although this construction prevents a loss of the drive string down the well upon slippage of the torque transmitting polished rod clamp, slippage of the clamp at high torque and the resulting damage to the polished rod cannot be prevented.

Thus, it is desirable to provide a drive head which will prevent damage to a polished rod due to slippage of a polished rod clamp during the pumping of very viscous fluids from deep wells.

SUMMARY OF THE INVENTION

It is an object of the invention to provide a drive head for a rotary down hole pump which reliably transmits torque to the drive string and permits vertical displacement of the drive string position.

It is another object of the invention to provide a rotary drive assembly for a rotary down hole pump that substantially prevents slippage of the polished rod at high torque, and therefore minimizes the risk of down hole pump damage.

It is yet another object of the invention to provide a drive head that includes a rotatable drive spindle for receiving a slip shaft incorporated into a top end of the drive string, whereby the shape of an axial passage through the drive spindle is complementary with the shape of the slip shaft so that rotation of the drive spindle relative to the slip shaft is inhibited while axial displacement of the slip shaft in the drive spindle is accommodated.

It is still another object of the invention to provide a drive head which is readily adjustable to receive slip shafts of varying shape and circumference.

It is a further object of the invention to provide a drive head which permits lifting of the drive string so that the polished rod can be pulled up through the drive head to permit a back wash of the down hole pump equipment.

In accordance with the invention there is provided a drive head for a rotary down hole pump driven by a drive string that extends through a well to the pump, the drive string being forcibly rotatable by a torque transmitting drive, comprising:

- a drive spindle having an axis and including an axial shaft receiving passage for receiving a slip shaft connected to a top end of the drive string, the shaft receiving passage and the slip shaft being respectively and complementarily shaped to permit axial displacement of the slip shaft within the shaft receiving passage while inhibiting rotational movement of the slip shaft within the shaft receiving passage to permit the transmission of torque from the drive spindle to the drive string; and
- a housing for rotatably supporting the drive spindle on a well head assembly, whereby the drive spindle is rotatable about the axis.

In a first preferred embodiment, the drive spindle is a hollow drive spindle which includes an integral shaft receiving passage.

In another preferred embodiment, the drive spindle is adapted to accommodate slip shafts of different shape and/or circumference and the drive spindle includes an interchangeable drive bushing having an axial shaft receiving passage sized to receive a slip shaft of selected cross-section, a drive spindle having a bore for co-axially receiving a drive bushing, a stop means for retaining the drive bushing in the bore, and means for preventing rotation of the drive bushing relative to the drive spindle. The drive spindle preferably has a first and second axial bore, the second axial bore having a diameter that is smaller than the first axial bore but larger than the maximum diameter of the polished rod, and the stop means is preferably an annular shoulder located at the transition between the first and second axial bores. Preferably, opposite surfaces of the drive bushing and the drive spindle are respectively provided with a key receiving groove and the means for preventing rotation is a key inserted in the key receiving grooves to lock the drive bushing against rotation in the drive spindle.

The housing preferably includes a threaded fitting attachable to the well head assembly and bearings for rotatably supporting the drive spindle in the housing.

In another preferred embodiment, the drive head further includes a stuffing box for providing a fluid seal around the drive string at the well head assembly.

The cross-sectional shape of the slip shaft preferably corresponds with the cross-sectional shape of the shaft receiving passage. The slip shaft and the shaft receiving passage are preferably of hexagonal cross-section and the slip shaft is preferably sized to fit closely in the passage. The drive string is preferably a sucker rod string that includes a polished rod at a top of the string, and the slip shaft is preferably screwed onto a top end of the polished rod.

In another aspect, the invention provides a drive assembly for a rotary down hole pump driven by a drive string rotatable within a production string of a well, the drive assembly including a drive head in accordance with the invention for rotating the drive string, means for suspending the weight of the drive string from the drive head, and drive means for rotating the shaft receiving means relative to the mounting means. The means for suspending is preferably a clamp on the slip shaft having a bore complementary to the cross section of the slip shaft, supported by the shaft receiving means. In a preferred embodiment, the drive means includes a torque producing means, preferably an electric motor having a shaft, and a torque transmitting means for the transmission of torque generated by the torque producing means to the drive head, preferably a pulley and belt arrangement.

DETAILED DESCRIPTION OF THE PREFERRED EMBODIMENTS

The invention will now be further described by way of example only and with reference to the following drawings, wherein.

Figure 1:
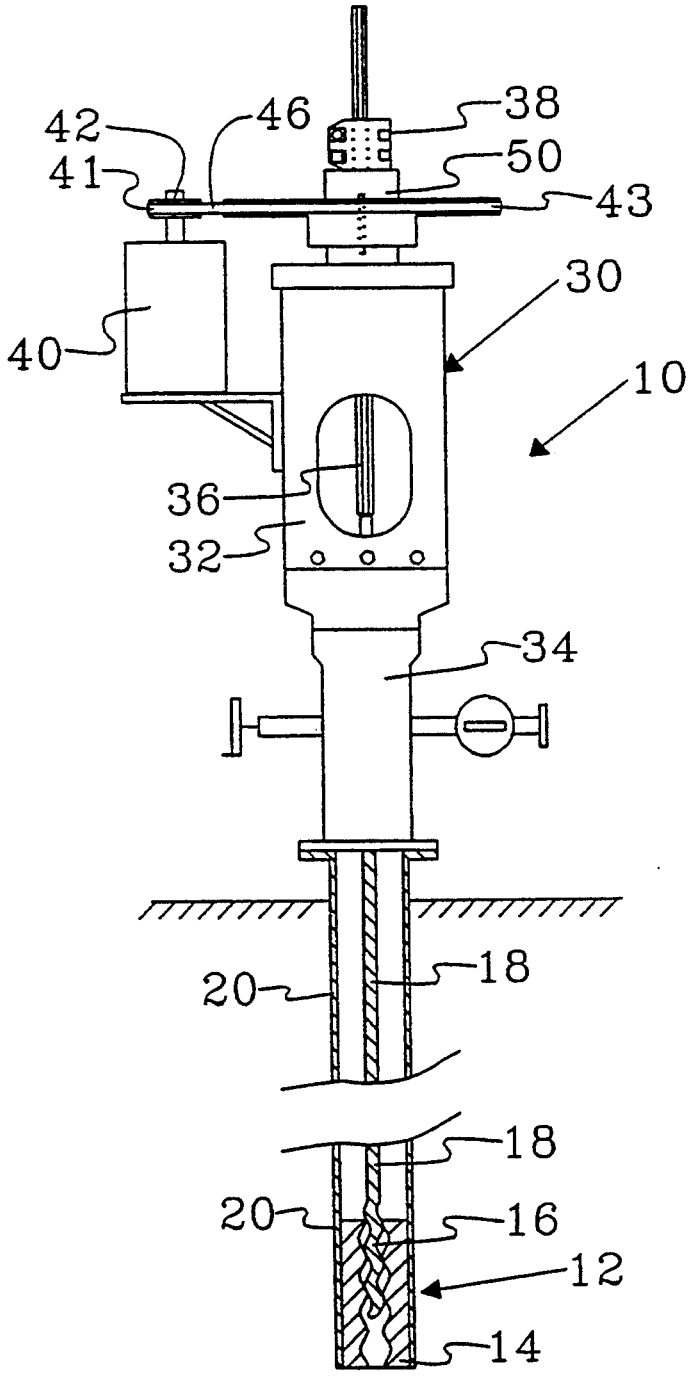
FIG. 1 is a schematic side elevational view of a rotary down hole pump arrangement which is operated by a drive head assembly in accordance with the invention.

A preferred embodiment of a rotary down hole pump drive head assembly 10 in accordance with the invention is shown in FIG. 1 and is used for the operation of a progressing cavity down hole pump 12 which includes a stator 14 and a rotor 16. The rotor 16 is connected with a drive head assembly by a drive string 18 that is rotatable in a production tubing or a well casing 20. The rotary drive assembly 10 includes a drive head 30, the construction of which will be discussed in detail below with reference to FIGS. 2 to 4. The drive head 30 includes a housing 32 which is screwed to the top end of a well head assembly 34. The drive string 18 includes a slip shaft 36, preferably of hexagonal cross-section, which extends through and is rotated by drive head 30 as will be described below. The drive string 18 is suspended from the drive head 30 by way of a clamp 38 which is shaped to accommodate an end of the slip shaft 36 that protrudes upward from the spindle 50. The clamp 38 is fastened to the drive string above the drive head and rests on a top surface thereof. Torque from an electric motor 40 is transmitted to the drive head 30 through a conventional V-belt and pulley arrangement 42 which includes a drive pulley 41 and a driven pulley 43, respectively mounted to a drive shaft 42 of the motor 40 and a drive spindle 50 of the drive head 30. A V-belt 36 tensioned around pulleys 40 and 42 transfers torque from the motor 40 to the drive spindle 50. The mounting of driven pulley 43 to the drive spindle 50 will be discussed in detail with reference to FIG. 4. Alternatively, the drive spindle 50 may be driven by a right-angle gear drive powered by an internal combustion engine (not illustrated) or a comparable power source, in a manner well known in the art.

Figure 2:
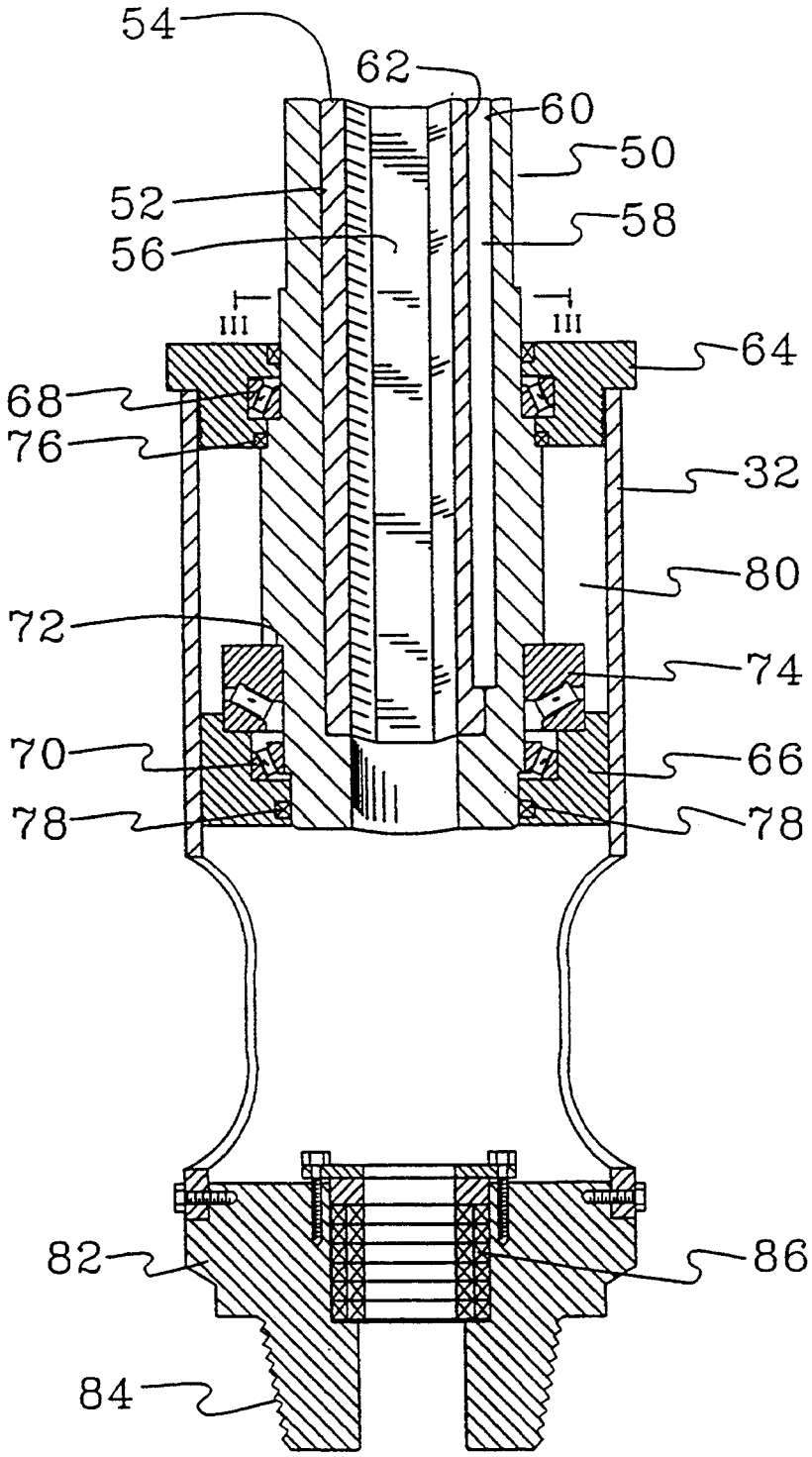
FIG. 2 is an axial cross-sectional view through a preferred embodiment of a drive head in accordance with the invention.
Figure 3:
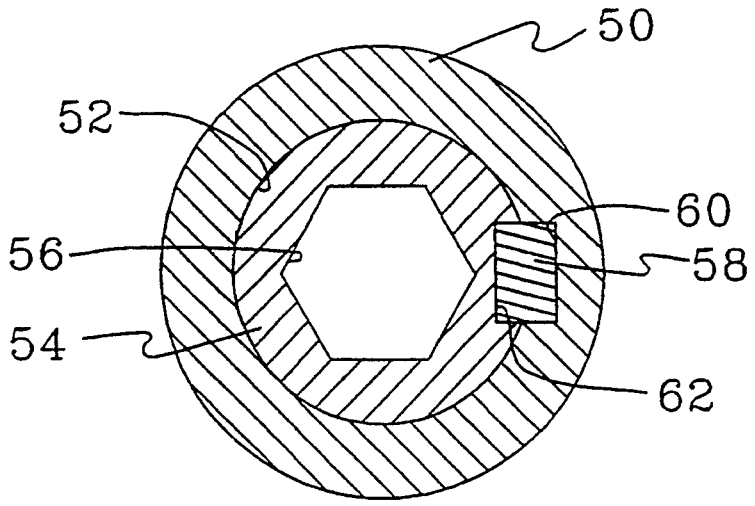
FIG. 3 is a radial cross-sectional view taken along line III—III of FIG. 2.

FIGS. 2 and 3 illustrate a preferred drive head in accordance with the invention. The drive head 10 includes the housing 32 which accommodates a hollow drive spindle 50 having an axial cylindrical bore 52 sized to receive a cylindrical drive bushing 54 that has a shaft receiving passage 56 sized to receive the slip shaft 36 (see FIG. 4). The shaft receiving passage 56 and the slip shaft 36 are preferably hexagonal in cross-section but other shapes may be equally servicable. The diameter of the cylindrical bore 52 in the drive spindle 50 is sized to closely receive the outer diameter of the drive bushing 54 so that the bushing fits snugly in the spindle (see FIG. 3). Rotation of the drive bushing 54 in the cylindrical bore 52 of the drive spindle 50 is inhibited by a key 58 inserted into keyways 60, 62 respectively provided in opposite surfaces of the drive spindle and the drive bushing. The housing 32 includes upper and lower bearing mounts 64, 66 (FIG. 2) which are respectively screwed and welded to the housing. The drive spindle 50 is rotatably supported in the housing 32 by upper and lower radial bearings 68, 70 which are respectively mounted in upper and lower annular bearing mounts 64, 66. The drive sleeve 50 has an outer annular shoulder 72 which rests against the load carrying axial thrust bearing 74 mounted on the lower bearing mount 66. The axial thrust bearing 74 supports the weight of the drive spindle 50 and, thus, the drive string 18 (FIG. 1) suspended therefrom (see FIG. 4 also). An upper and a lower annular seal 76, 78, positioned between the upper and lower bearing mounts 64, 66 and the drive sleeve 50, respectively seal a lubricant chamber 80, which is at least partly filled with a lubricating fluid (not illustrated). A bottom end 82 of the housing 32 has a conventional threaded frustoconical union 84 (NPT or API) for connecting the housing to the well head assembly 34 (see FIG. 1). The bottom end 82 of the housing 32 also includes a stuffing box 86 for providing a fluid seal between a polished rod 88 (see FIG. 4) which is part of the drive string 18 and the production tubing 20.

Figure 4:
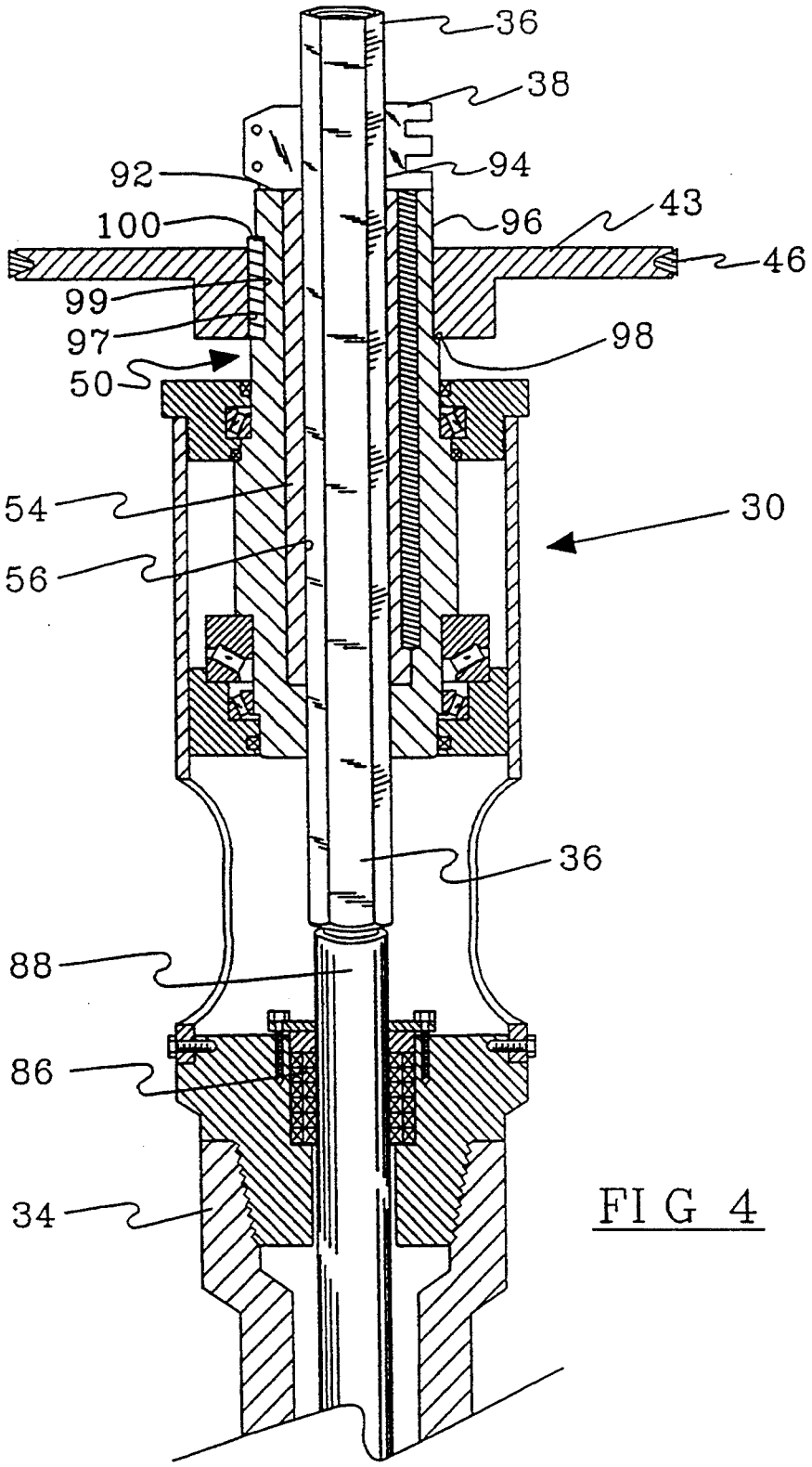
FIG. 4 is an axial cross-sectional view through the drive head assembly shown in FIG. 1, taken along a plane perpendicular to the drawing plane of FIG. 1.

Referring now to FIG. 4, during operation of the drive head 30, the slip shaft 36 is received in the shaft receiving passage 56. The diameter of the shaft receiving passage 56 in the drive bushing 54 essentially corresponds to the shape and diameter of the slip shaft 36 so that wobble of the slip shaft and, consequently, the polished rod is avoided. Nonetheless, axial displacement of the slip shaft in the bushing is still accommodated. The minimum diameter of the hexagonal slip shaft 36 and the size of the shaft receiving passage 56 are larger than the outer diameter of the polished rod 88, which permits lifting of the drive string 18 far enough to withdraw the rotor 16 from the stator 14 (see FIG. 1) by lifting the polished rod up through the stuffing box 86 and the shaft receiving passage 56. This permits back washing of the down hole pumping equipment without disassembling the drive head arrangement. Back washing of down hole pumping equipment is generally done using water or clean crude oil to remove viscous accumulations of sand, paraffin or the like which have clogged the pump or the production tubing.

The polished rod 88 is screwed to the top end of the drive string 18. The polished rod 88 extends through the stuffing box 86 which provides a fluid seal around the polished rod to inhibit the escape of hydrocarbons to atmosphere. Each of drive bushings 54 has the same outer diameter, but the shaft receiving passages 56 may be sized and shaped to accommodate slip shafts 36 of a variety of cross-sectional shapes and sizes. The slip shaft 36 is screwed onto the top end of the polished rod 88 by way of a standard polished rod box and pin thread connection well known in the art.

The driven pulley 43 is mounted onto the upper portion 96 of the drive spindle 50 (see FIGS. 1 and 4) which includes an annular shoulder 98 on which the pulley is supported. A key 100 inserted into key ways 97, 99 respectively provided in opposite surfaces of the driven pulley 43 and the drive spindle 50 prevents rotation of the pulley on the drive spindle and allows the transmission of torque from the pulley to the drive spindle. A V-belt 46 is tensioned around driven pulley 43 and drive pulley 41 (see FIG. 1) so that the drive spindle 50 can be rotated by way of the electric motor 40.

The drive head 30 is installed on the well head 34 by inserting the upper end of the drive string 18, which is the polished rod 88, (FIG. 4) through the stuffing box 86 and the drive bushing 54 and sliding the drive head down along the polished rod 88 until the housing 32 engages the top of the well head assembly 34. The housing 32 is then screwed directly to the well head assembly 34. During installation of the drive head 30, the weight of the drive string 18 (FIG. 1) must be supported by using, for example, a polished rod clamp in combination with a supporting arrangement, such as a hoist or crane (not shown). Then, the slip shaft 36 is screwed onto the top end of the polished rod and the drive spindle 50 is slowly rotated back and forth as the drive string is lowered to facilitate insertion of the slip shaft 36 into the shaft receiving passage 56 of the drive bushing 54. A clamp 38 is subsequently installed on the drive string 18 directly adjacent the upper end 92 of the drive spindle 50. The clamp 38 has a central opening 94 complementary with the slip shaft 36. The drive string 18 is released from the hoist or crane (not shown) so that the weight of the drive string is supported by the clamp 38 which rests on top of the drive spindle 50. It should be noted that other arrangements for supporting the drive string 18 can also be used. For example, the clamp 38 can be replaced with a collar and pin arrangement (not illustrated) well known in the art. Clamping the slip shaft 36 completes the installation of the rotatable drive assembly and pumping can begin. Adjustment of the vertical position of the drive string 18 may be readily accomplished when necessary by once again suspending the drive string either from a hoist, or the like, loosening clamp 38 (FIG. 1) and raising or lowering the drive string 18 as required by way of the hoist. The clamp 38 is then repositioned against the upper end 92 of the drive spindle 50 and retightened and the drive string is disconnected from the hoist.

It will be readily appreciated that certain modifications which would not affect their overall function may be made to the above described preferred embodiments of the invention. For example, torque transmitting means other than the pulley-belt combination described above used for transmitting torque from the motor to the drive head can be used such as a sprocket-chain combination or a set of intermeshed gears or any other arrangement that will permit the transmission of torque from a power source to the drive sleeve 50. Means for suspending the weight of the drive string other than clamp 90 may be used such as the pin and collar described above. As long as downward drive string slippage is reliably prevented the structure of the clamping arrangement is not important. Torque producing means other than the electric motor 40 can be used, for example internal combustion engines. Finally, the slip shaft 36 and the shaft receiving passage 56 need not have the same shape. A slip shaft which has a cross-sectional shape complementary but not identical to the shape of the shaft receiving passage can be used as long as rotation of the shaft in relation to the bushing 54 and/or spindle 50 is reliably inhibited. Also, the drive bushing 54 may be omitted and the shaft receiving passage 56 provided directly in the drive spindle 50.

The drive head for a rotary down hole pump described above provides for a reliable transmission of drive torque while minimizing the potential for slippage of the drive string. It is also readily adaptable to accommodate slip shafts of different size and shape.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. In a drive head for a rotary down hole pump driven by a drive string that extends through a well to the pump, the drive string being supported by the drive head forcibly rotatable by a torque transmitting drive, the drive head including a forcibly rotatable drive spindle and a drive bushing received in a keyed seat of the drive spindle and mountable to the drive string for transmitting torque from the drive spindle to the drive string, the improvement comprising:

a drive spindle for directly rotating the drive string, the drive spindle having an axis and including an axial shaft receiving passage for slidably receiving a slip shaft having a non-circular cross-section and being connected to a top end of the drive string, the shaft receiving passage having a cross-section complementary in shape to the non-circular cross-section of the slip shaft to permit axial displacement of the drive shaft within the shaft receiving passage while inhibiting rotational movement of the drive shaft within the shaft receiving passage to permit the direct transmission of torque from the drive spindle to the drive string; and a housing for rotatably supporting the drive spindle on a well head assembly, whereby the drive spindle is not rotatable about the axis.

2. A drive head as claimed in claim 1 wherein the housing attachable to the well head assembly includes a load carrying thrust bearing and two spaced-apart radial bearings for rotatably supporting the drive spindle in the housing.

3. A drive head as claimed in claim 2, wherein the drive head further includes a stuffing box for sealing the well head assembly around the drive string.

4. A drive head as claimed in claim 1, wherein a cross-sectional shape of the slip shaft corresponds to the cross-sectional shape of the shaft receiving passage.

5. A drive head as claimed in claim 4, wherein the slip shaft has a hexagonal cross-sectional shape and the shaft receiving passage has a hexagonal cross-sectional shape, the slip shaft being sized to fit closely within the shaft receiving passage to prevent drive string wobble.

6. A drive head as claimed in claim 5, wherein the slip shaft has first and second ends, the first end having a polished rod pin thread, and the second end having a polished rod box thread which threadably engages the drive string.

7. A drive head for a rotary down hole pump driven by a drive string that extends through a well to the pump, the drive string being supported by the drive head and forcibly rotatable by a torque transmitting drive, comprising a drive spindle having an axis and including an axial shaft receiving passage for receiving a non-circular slip shaft having a non-circular cross-section connected to a top end of the drive string, the shaft receiving passage having a cross-section complementary to the cross-section of the slip shaft to permit axial displacement of the slip shaft within the shaft receiving passage while inhibiting rotational movement of the slip shaft within the shaft receiving passage to permit the direct transmission of torque from the drive spindle to the drive string;

a housing for rotatably supporting the drive spindle on a well head assembly, whereby the drive spindle is rotatable about the axis; and the outer diameter of the slip shaft and the diameter of the shaft receiving passage are larger than the outer diameter of the drive string to permit lifting of the drive string through the drive head for backwashing of down hole pumping equipment operated by the drive string.

8. A rotary drive assembly for a rotary down hole pump driven by a drive string that extends through a wall to the pump, the drive string being supported from and forcibly rotatable by a drive head, comprising:

a drive spindle having an axis and including an axial shaft receiving passage for receiving a slip shaft having a non-circular cross-section and being connected to a top end of the drive string, the shaft receiving passage having a non-circular cross-section complementary in shape to the non-circular cross-section of the slip shaft to permit axial displacement of the slip shaft within the shaft receiving passage while inhibiting rotational movement of the slip shaft within the shaft receiving passage to permit the direct transmission of torque from the drive spindle to the drive string; and a housing for rotatably supporting the drive spindle on a well head assembly, the drive spindle being rotatable about the axis;

a clamp for supporting the drive string in the well; and drive means affixed to the drive spindle for transmitting torque to the drive spindle to rotate the drive spindle about the axis and thereby forcibly rotate the drive string.

9. A rotary drive assembly as claimed in claim 8, wherein the clamp is mounted on the slip shaft adjacent a top surface of the drive spindle.

10. A rotary drive assembly as claimed in claim 8, wherein the drive head includes a torque producing means for generating torque for driving the drive spindle, and a torque transmitting means for transmitting torque from the torque producing means to the drive means affixed to the drive spindle.

11. A rotary drive assembly as claimed in claim 10 wherein the drive means affixed to the drive spindle is a pulley.

12. A rotary drive assembly as defined in claim 11, wherein the torque producing means is an electric motor having a shaft, and the torque transmitting means includes a drive pulley mounted to the shaft of the electric motor, the pulley mounted on the shaft of the drive spindle and a belt tensioned around the respective pulleys.

* * * * *

UNITED STATES PATENT AND TRADEMARK OFFICE

CERTIFICATE OF CORRECTION

PATENT NO. : 5,370,179

DATED : DECEMBER 6, 1994

INVENTOR(S) : ROBERT A. R. MILLS

It is certified that error appears in the above-identified patent and that said Letters Patent is hereby corrected as shown below:

At 56, Cover, Page 1, Under "Foreign References", delete "20416311" and substitute therefor ---2016311---;

Signed and Sealed this

Fourteenth Day of November, 1995

*Attest:*

*Attesting Officer*

Bruce Lehman

BRUCE LEHMAN

*Commissioner of Patents and Trademarks*